US008596487B1

(12) United States Patent
Su

(10) Patent No.: US 8,596,487 B1
(45) Date of Patent: Dec. 3, 2013

(54) CARRIER UNIT FOR CARRYING PARTS BOXES

(71) Applicant: Chung-Shiu Su, Kaohsiung (TW)

(72) Inventor: Chung-Shiu Su, Kaohsiung (TW)

( * ) Notice: Subject to any disclaimer, the term of this patent is extended or adjusted under 35 U.S.C. 154(b) by 0 days.

(21) Appl. No.: 13/671,675

(22) Filed: Nov. 8, 2012

(51) Int. Cl.
*B25H 3/02* (2006.01)
*B25H 3/06* (2006.01)
*B65D 85/00* (2006.01)

(52) U.S. Cl.
USPC ..... 220/524; 220/522; 206/486

(58) Field of Classification Search
CPC ..... B25H 3/02; B25H 3/021; B25H 3/026
USPC ..... 206/486, 372, 373, 538, 473, 472, 561, 206/562, 563; 220/521, 528, 522, 524
See application file for complete search history.

(56) References Cited

U.S. PATENT DOCUMENTS 5,826,718 A * 10/1998 Ahern et al. ..... 206/372
6,076,663 A * 6/2000 Shima ..... 206/216
8,469,195 B2 * 6/2013 Gosselink et al. ..... 206/769

* cited by examiner

*Primary Examiner* — David Fidei
(74) *Attorney, Agent, or Firm* — Rosenberg, Klein & Lee

(57) ABSTRACT

A carrier unit for carrying boxes includes at least one carrier having multiple holes defined therethrough and two first engaging portions are provided on two insides of each of the holes. Multiple parts boxes are engaged with the holes and each box has a body and a cover which is pivotably connected to the body. The body has two second engaging portions which can be engaged with the first engaging portions when the body is installed in one of the holes. The cover has two protruded portions which contact the carrier when the cover is opened so that the second engaging portions can be disengaged from the first engaging portions.

6 Claims, 7 Drawing Sheets

CARRIER UNIT FOR CARRYING PARTS BOXES

FIELD OF THE INVENTION

The present invention relates to a carrier unit for carrying parts boxes, and the parts box is raised when the opening the cover of the box.

BACKGROUND OF THE INVENTION

U.S. Pat. No. 6,076,663 discloses a conventional carrier for accumulating containers and comprises two carries and multiple containers. The carrier has a plurality of fitting holes. Two protruding ribs are arranged on the opposite sides of the fitting hole. Each of the containers has a cone-shaped body which has a section has the same width as the fitting hole so that the containers are fitted in the fitting holes and the cone-shaped body of each container passed through the fitting hole. The protruding ribs secure the top of the container so that the container is positioned to the carrier.

However, the user has to pull open the protruding ribs by two hands to pick the container out from the carrier. Further, the user then has to open the cover of the container to access the parts in the container. The processes are complicated and inconvenient. Besides, when opening the cover, the cover is easily deformed such that the cover is hard to open.

The present invention intends to provide a carrier unit for carrying boxes and the box is easily opened so as to improve the shortcomings of the conventional one.

SUMMARY OF THE INVENTION

The present invention relates to a carrier unit for carrying parts boxes and comprises at least one carrier having multiple holes defined therethrough and two first engaging portions are provided on two insides of each of the holes. Multiple parts boxes are engaged with the holes and each box has a body and a cover which is pivotably connected to the body. The body has two second engaging portions which are engaged with the first engaging portions when the body is engaged with one of the holes. The cover has two protruded portions which contact the carrier when the cover is opened so that the second engaging portions can be disengaged from the first engaging portions.

Preferably, a gap is formed between the body and the cover when the body is not yet engaged with the hole. The protruded portions extend from the cover and are located close to the pivotal portion between the body and the cover. The length of each of the protruded portions is longer than the gap.

Preferably, the body has a first locking portion/snap-fit portion and the cover has a second snap-fit portion which is located corresponding to the first locking portion/snap-fit portion.

Preferably, the cover has a reinforcement portion extending therefrom which is located close to the second locking portion/snap-fit portion.

Preferably, the body has a space defined therein and two ribs extend from each of two insides of the space. A separation plate is engaged with two respective slots defined by the ribs on the two insides of the space.

Preferably, the box has a bottom which is located corresponding to the cover and the bottom has at least one protrusion. The cover has a recessed engaging slot which is located corresponding to the protrusion.

One aspect of the present invention is to provide a carrier unit wherein the first engaging portions on the carrier is engaged with the body of the box so as to facilitate to open the cover. The length of the protruded portions are longer than the gap between the carrier and the cover so that when the user opens the cover of the box, the protruded portions on the cover contact against the carrier to lift the box, and the second engaging portions are disengaged from the first engaging portions. Therefore, when the cover is opened, the box is lifted to easily pick the parts in the box or to be easily disassembled from the carrier.

Another aspect of the present invention is that the cover has a reinforcement portion extending therefrom which is located close to the second snap-fit portion so that the cover is strengthened. Therefore, when the cover is opened and the protruded portions 222 is contacting against the carrier 1, the cover 22 cannot be deformed easily to facilitate the disassembly of the body 21 of the box 2 from the hole 11 of the carrier 1.

Still another aspect of the present invention is that the box has a bottom having at least one protrusion, and a cover having a recessed engaging slot which is located corresponding to the protrusion. When stacking the boxes, the protrusion on the bottom of one box is connected with the engaging slot on the cover of another box. By this way, the boxes are securely stacked relative to each other.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
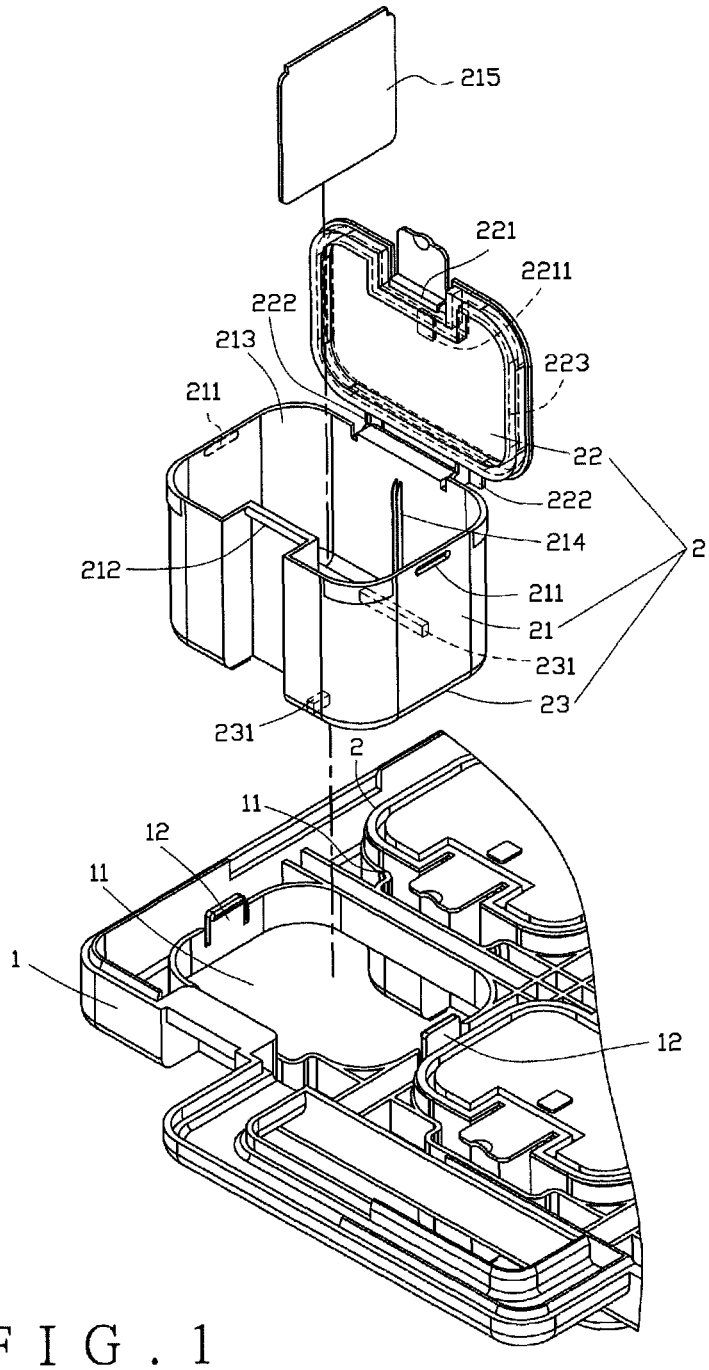
FIG. 1 is an exploded view to show the carrier unit of the present invention.

Referring to FIGS. 1 to 4, the carrier unit of the present invention comprises at least one carrier 1 and multiple holes 11 are defined through the at least one carrier 1. Two first engaging portions 12 are provided on two insides of each of the holes 11. In this embodiment, there are multiple carriers 1 and multiple boxes 2.

Each box 2 has a body 21, a cover 22 pivotably connected to the body 21, and a bottom 23. The body 21 has two second engaging portions 211 and a first snap-fit portion 212, wherein the two second engaging portions 211 are engaged with the first engaging portions 12 when the body 21 is engaged with one of the holes 11. A gap "d" is formed between the body 21 and the cover 22 when the first and second engaged portions 12, 211 are engaged. The body 21 has a space 213 defined therein and two ribs 214 extend from each of two insides of the space 213. A separation plate 215 is engaged with a slot defined by the ribs 214 so as to divide the space 213 of the body 21 to at least two spaces.

The cover 22 has a second snap-fit portion 221 and two protruded portions 222. The second snap-fit portion 221 can be engaged with the first snap-fit portion 212 when the cover is closed. The cover 22 has a reinforcement portion 2211 extending therefrom which is located close to the second snap-fit portion 221. The protruded portions 222 extend from the cover 22 and are located close to the pivotal portion between the body 21 and the cover 22. The length of each of the protruded portions 222 is longer than the gap "d". The protruded portions 222 contact the carrier 1 when the cover 22 is opened (shown as FIG. 5) so that the second engaging portions 211 are disengaged from the first engaging portions 12.

Figure 5:
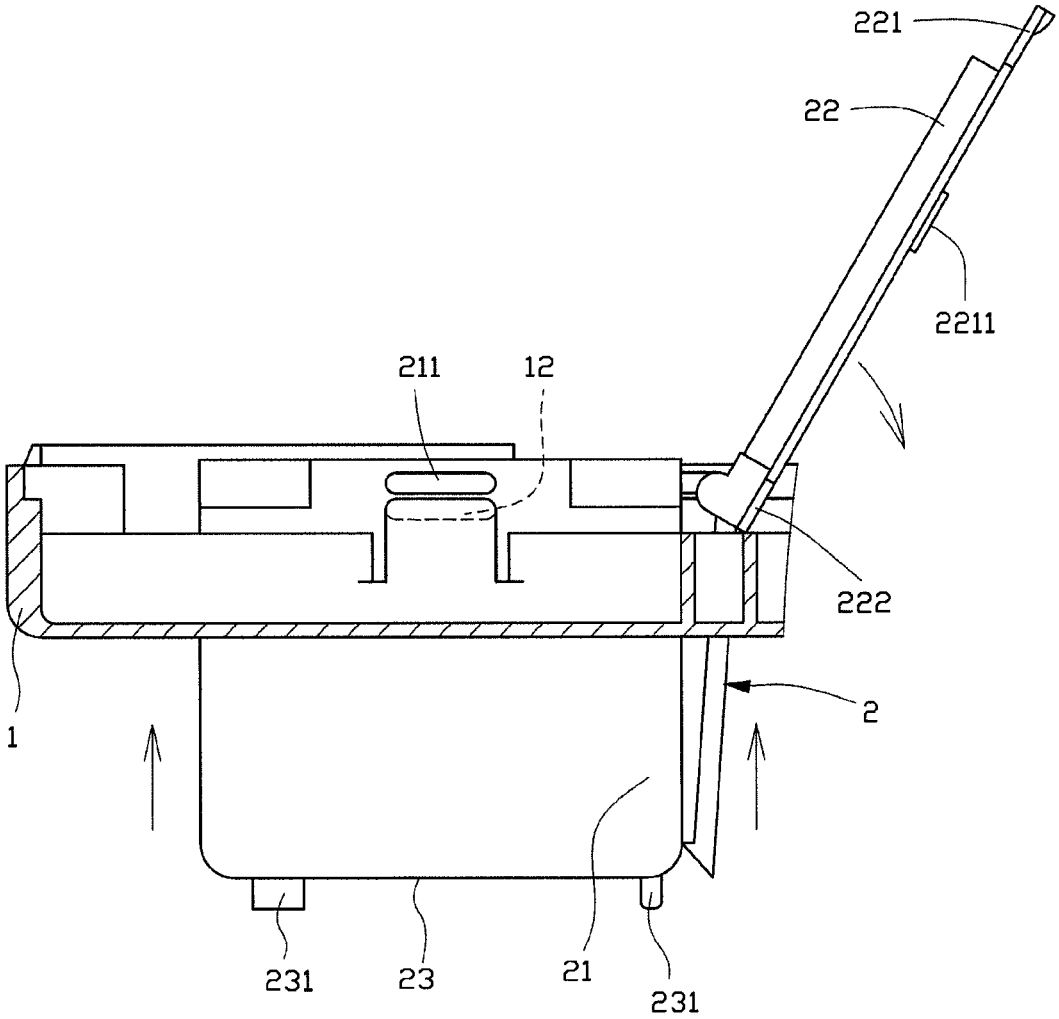
FIG. 5 shows that the cover of the box is opened.
Figure 6:
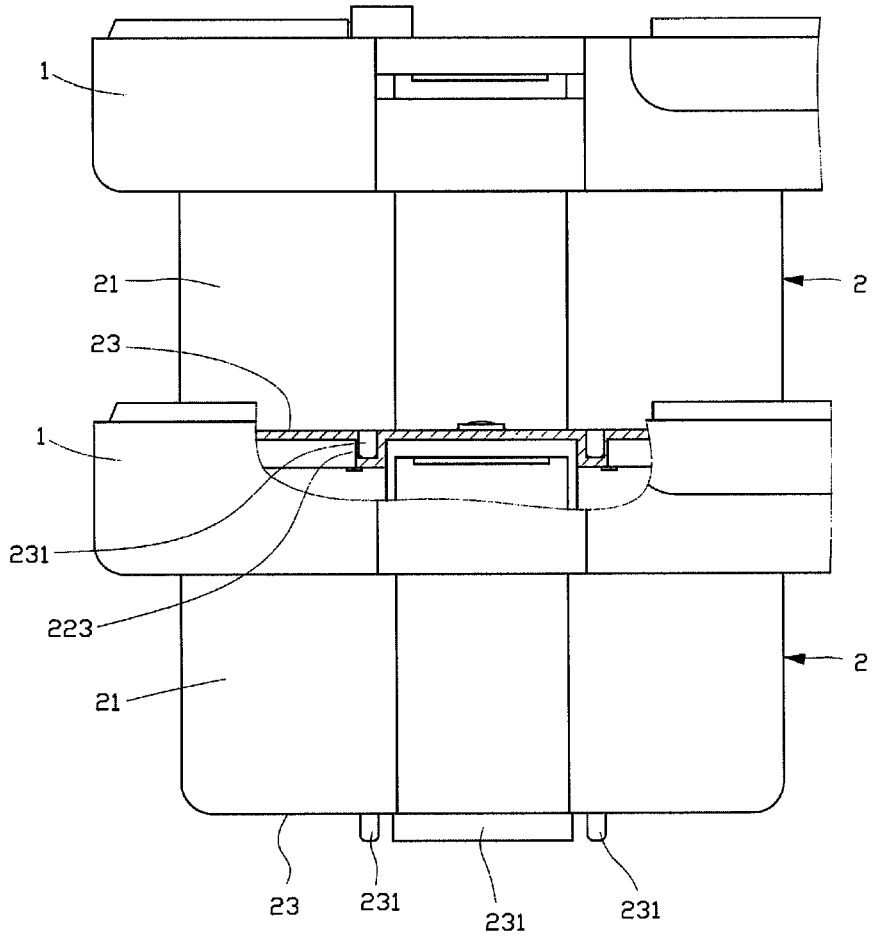
FIG. 6 shows that one carrier is stacked on another by their corresponding boxes.

As shown in FIGS. 5 and 6, the box has at least one protrusion 231 located on the bottom of the box 21. The cover 22 of the box 21 has a recessed engaging slot 223. Wherein, the protrusion 231 of the bottom of one box 21 can be located in the recessed engaging slot 223 of the cover of another box 21 (shown in FIG. 6) so that boxes 2 or the carriers 1 with boxes 2 can be arranged in one or more stack(s).

Figure 2:
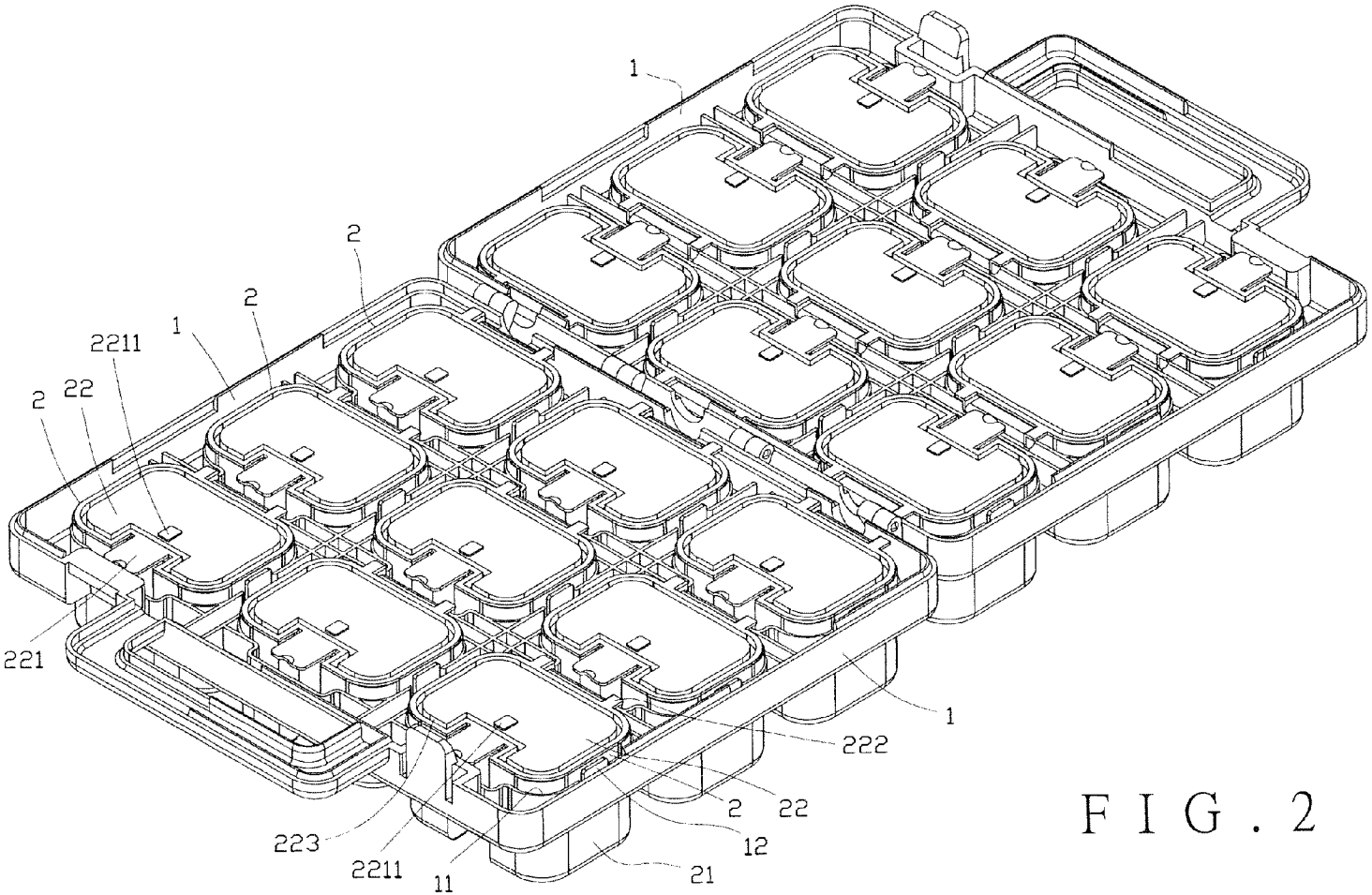
FIG. 2 is a perspective view to show the carrier unit of the present invention.
Figure 3:
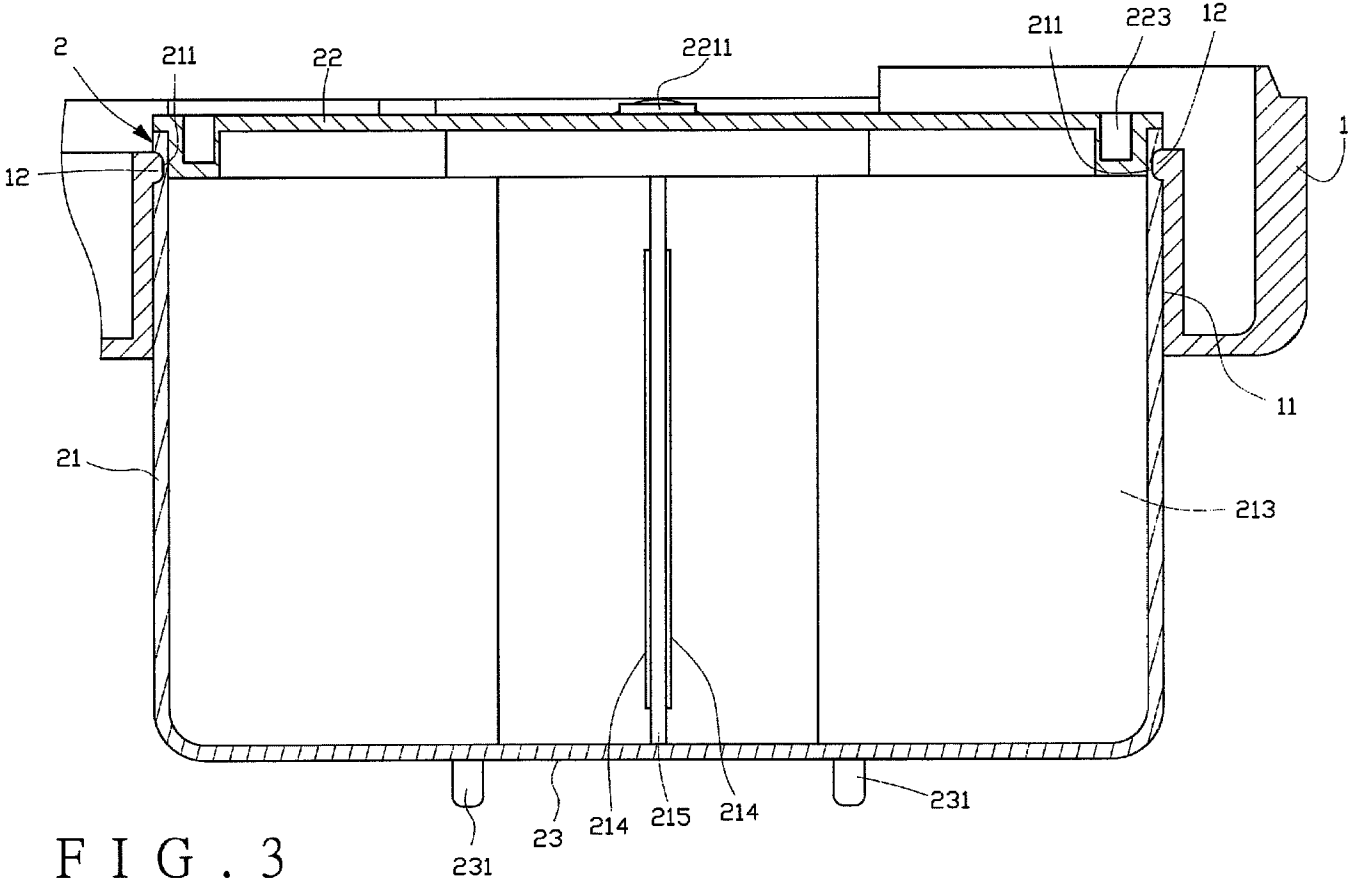
FIG. 3 is a front cross sectional view of the carrier and the box of the present invention.
Figure 7:
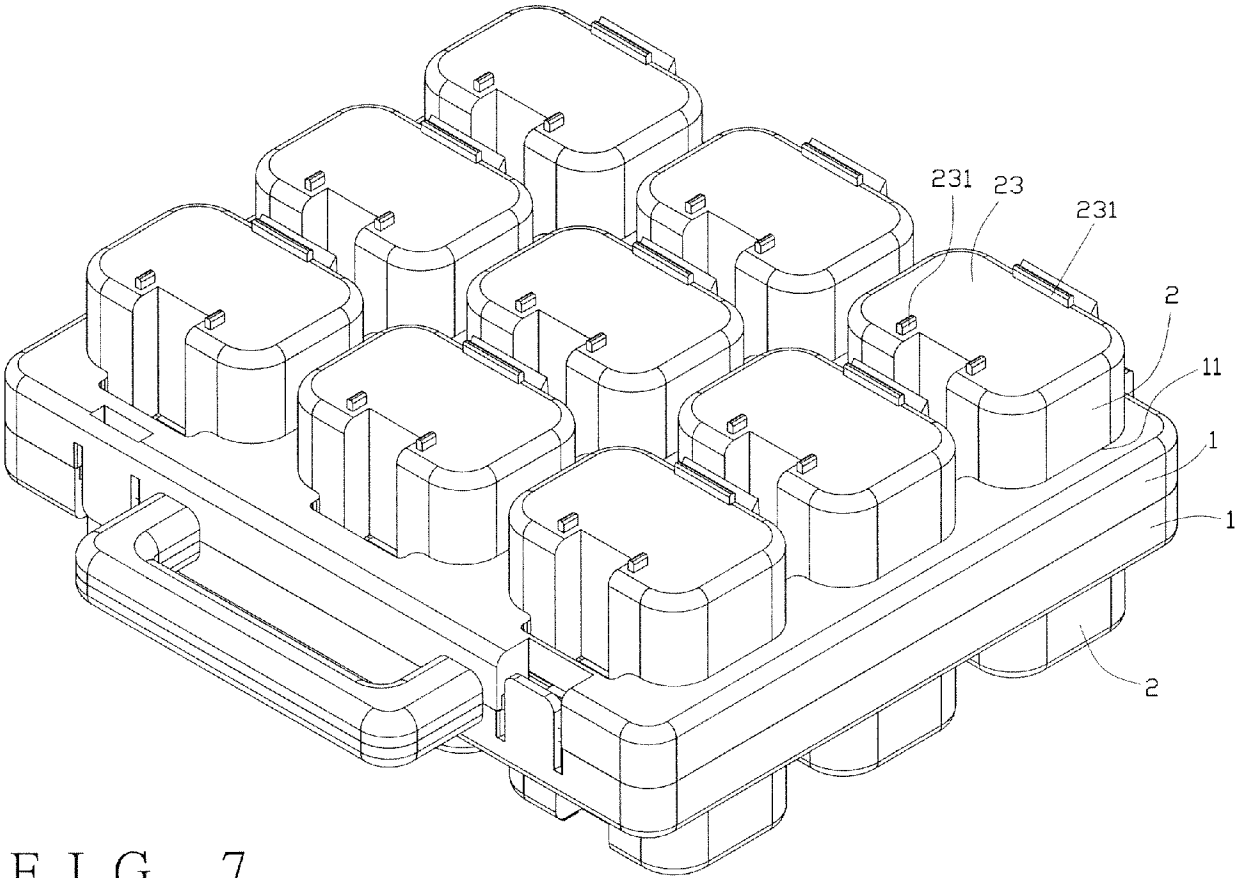
FIG. 7 shows the carrier unit is in closed status.

When in assembling, the bodies 21 of the boxes 2 are respectively engaged with the holes 11 of the carrier 1, and the second engaging portions 211 of the body 21 are engaged with the first engaging portions 12 of the carrier 1. Further, the two carriers 1 are pivotably connected to each other so that the two carriers 2 can be closed as a case as shown in FIG. 7 or opened as two corresponding carriers as shown in FIG. 2.

Figure 4:
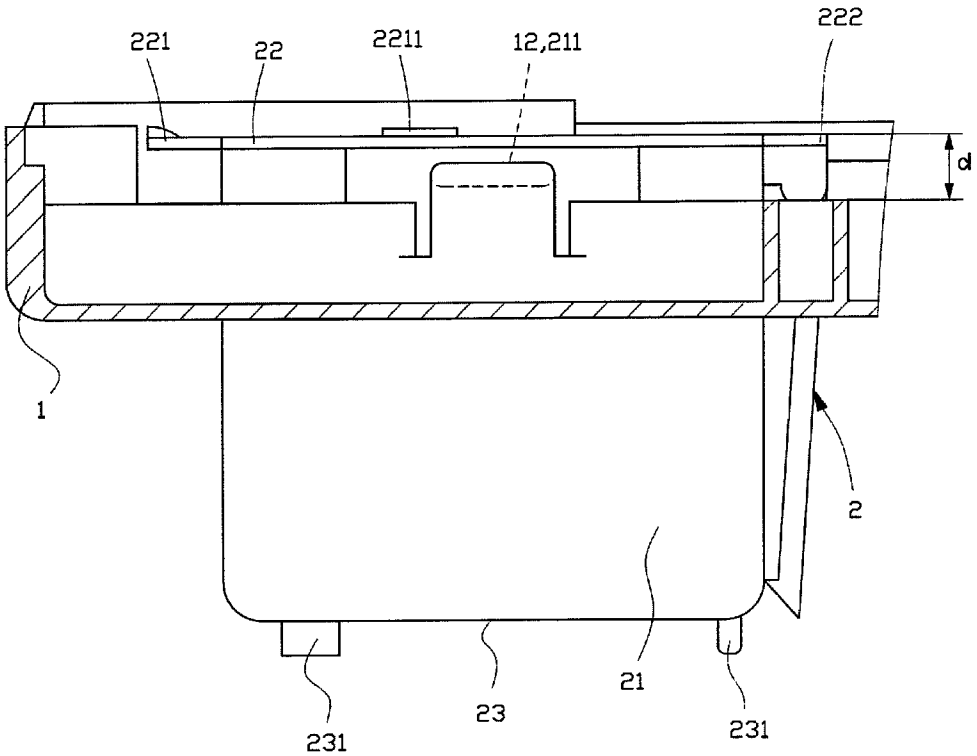
FIG. 4 is a side cross sectional view of the carrier and the box of the present invention.

Referring to FIGS. 4 and 5, the first engaging portions 12 are engaged with the body 21 of the box 2 but not the cover 22 so as to facilitate to open the cover 22. The length of the protruded portions 222 are longer than the gap "d" between the carrier 1 and the cover 22, so that when the user opens the cover 22 of the box 2, the protruded portions 222 push against the carrier 1, the box 2 is lifted by the lever principle and the second engaging portions 211 of the body 21 are disengaged from the first engaging portions 12 of the carrier 1. Therefore, when the cover 22 is opened, the box 2 is lifted to easily pick the parts in the box 2 or to be easily disassembled from the carrier 1. Besides, the cover 22 has a reinforcement portion 2211 extending therefrom which is located close to the second snap-fit portion 221 so that the cover 22 is strengthened. Therefore, when the cover is opened and the protruded portions 222 is contacting against the carrier 1, the cover 22 cannot be deformed easily to facilitate the disassembly of the body 21 of the box 2 from the hole 11 of the carrier 1.

As shown in FIG. 6, when stacking the boxes 2, the protrusion 231 on the bottom 23 of one box is connected with the engaging slot 223 on the cover 22 of another box 2. By this way, the boxes 2 can be stacked firmly.

While we have shown and described the embodiment in accordance with the present invention, it should be clear to those skilled in the art that further embodiments may be made without departing from the scope of the present invention.

What is claimed is:

1. A carrier unit for carrying boxes, comprising:

at least one carrier having multiple holes defined therethrough and two first engaging portions provided on two insides of each of the holes, and multiple boxes and each box having a body and a cover pivotably connected to the body, the body having two second engaging portions which are engaged with the first engaging portions when the body is engaged with one of the holes, and the cover having two protruded portions which contact the carrier when the cover is opened so that the second engaging portions are disengaged from the first engaging portions.

2. The carrier unit as claimed in claim 1, wherein a gap is formed between the carrier and the cover when the first and second engaged portions are engaged, the protruded portions extend from the cover and are located close to the pivotal portion between the body and the cover, and a length of each of the protruded portions is longer than the gap.

3. The carrier unit as claimed in claim 1, wherein the body has a first snap-fit portion, and the cover has a second snap-fit portion which is located corresponding to the first locking portion.

4. The carrier unit as claimed in claim 3, wherein the cover has a reinforcement portion extending therefrom which is located close to the second snap-fit portion.

5. The carrier unit as claimed in claim 1, wherein the body has a space defined therein and two ribs extend from each of two insides of the space, and a separation plate is engaged with a slot defined by the ribs.

6. The carrier unit as claimed in claim 1, wherein the box has a bottom having at least one protrusion formed therefrom, and the cover has a recessed engaging slot which is located corresponding to the protrusion.

* * * * *